US009089849B2

(12) United States Patent
Gu et al.

(10) Patent No.: US 9,089,849 B2
(45) Date of Patent: Jul. 28, 2015

(54) SINGLE-REGION-BOARD TYPE HIGH-TEMPERATURE ELECTROSTATIC DUST COLLECTOR

(75) Inventors: Zhongzhu Gu, Jiangsu (CN); Jinjin Xu, Jiangsu (CN); Liying Dong, Jiangsu (CN); Juanjuan Liu, Jiangsu (CN)

(73) Assignee: NANJING NORMAL UNIVERSITY (CN)

( * ) Notice: Subject to any disclaimer, the term of this patent is extended or adjusted under 35 U.S.C. 154(b) by 309 days.

(21) Appl. No.: 13/881,222

(22) PCT Filed: Oct. 29, 2010

(86) PCT No.: PCT/CN2010/078217

§ 371 (c)(1),
(2), (4) Date: Apr. 24, 2013

(87) PCT Pub. No.: WO2012/055110

PCT Pub. Date: May 3, 2012

(65) Prior Publication Data

US 2013/0220128 A1 Aug. 29, 2013

(51) Int. Cl.

| | |
|---|---|
| ***B03C 3/86*** | (2006.01) |
| ***B03C 3/34*** | (2006.01) |
| ***B03C 3/40*** | (2006.01) |
| ***B03C 3/08*** | (2006.01) |
| ***B03C 3/47*** | (2006.01) |
| ***B03C 3/60*** | (2006.01) |

(52) U.S. Cl.

CPC ... *B03C 3/86* (2013.01); *B03C 3/08* (2013.01); *B03C 3/34* (2013.01); *B03C 3/40* (2013.01); *B03C 3/47* (2013.01); *B03C 3/60* (2013.01)

(58) Field of Classification Search

CPC combination set(s) only.
See application file for complete search history.

(56) References Cited

U.S. PATENT DOCUMENTS

| | | | | | |
|---|---|---|---|---|---|
| 4,313,741 | A | * | 2/1982 | Masuda et al. | 96/78 |
| 4,477,268 | A | * | 10/1984 | Kalt | 96/99 |
| 4,549,887 | A | * | 10/1985 | Joannou | 96/58 |
| 4,978,372 | A | * | 12/1990 | Pick | 96/67 |
| 5,055,118 | A | * | 10/1991 | Nagoshi et al. | 96/88 |
| 5,108,470 | A | * | 4/1992 | Pick | 96/58 |

(Continued)

FOREIGN PATENT DOCUMENTS

| | | | |
|---|---|---|---|
| CN | 101322957 | A | 12/2008 |
| CN | 201419123 | Y | 3/2010 |

(Continued)

OTHER PUBLICATIONS

International Search Report; PCT/CN2010/078217; Int'l File Date: Oct. 29, 2010; Nanjing Normal University; 5 pages.

*Primary Examiner* — Duane Smith
*Assistant Examiner* — Sonji Turner
(74) *Attorney, Agent, or Firm* — Schmeiser, Olsen & Watts LLP

(57) ABSTRACT

A single-region-board type high temperature electrostatic dust collector comprising anode boards (1), a cathode board (2), emitting electrodes (3) and a high voltage power supply is provided. Two parallel corrosion resistant plates are grounded to form the anode boards (1). One corrosion resistant plate with the same shape and size as the anode boards (1) connects to the cathode of the high voltage power supply, so as to form the cathode board (2), which are suspended between the two anode boards (1) and parallel with the anode boards (1). The disk-shaped emitting electrodes (3) are uniformly embedded at two sides of the cathode board (2).

1 Claim, 1 Drawing Sheet

(56) References Cited

U.S. PATENT DOCUMENTS

| | | | | | |
|---|---|---|---|---|---|
| 5,336,299 | A * | 8/1994 | Savell | 95/70 |
| 5,573,577 | A * | 11/1996 | Joannou | 96/66 |
| 6,004,376 | A * | 12/1999 | Frank | 95/79 |
| 6,773,488 | B2 * | 8/2004 | Potter | 95/59 |
| 6,805,732 | B1 * | 10/2004 | Billiotte et al. | 96/66 |
| 7,048,780 | B2 * | 5/2006 | Kim et al. | 95/78 |
| 7,258,729 | B1 * | 8/2007 | Barsimanto et al. | 96/66 |
| 7,431,755 | B2 * | 10/2008 | Kobayashi et al. | 96/69 |
| 7,438,747 | B2 * | 10/2008 | Luo | 96/96 |
| 7,815,720 | B2 * | 10/2010 | McKinney | 96/63 |
| 8,002,876 | B2 * | 8/2011 | Frank et al. | 95/73 |
| 8,091,167 | B2 * | 1/2012 | Teo et al. | 15/1.51 |
| 8,470,084 | B2 * | 6/2013 | Ji et al. | 96/69 |
| 8,721,775 | B2 * | 5/2014 | Chesebrough | 96/66 |
| 2004/0226448 | A1 * | 11/2004 | Griffiths et al. | 96/67 |
| 2005/0073261 | A1 * | 4/2005 | Takeuchi et al. | 315/169.1 |
| 2006/0130658 | A1 * | 6/2006 | Chang et al. | 96/77 |
| 2009/0165648 | A1 * | 7/2009 | Frank et al. | 95/73 |
| 2010/0147151 | A1 * | 6/2010 | Ji et al. | 96/80 |
| 2012/0148834 | A1 * | 6/2012 | Skoog et al. | 428/334 |
| 2014/0373717 | A1 * | 12/2014 | Wang | 96/60 |

FOREIGN PATENT DOCUMENTS

| | | | |
|---|---|---|---|
| CN | 102580854 | A * | 7/2012 |
| CN | 102580854 | B * | 7/2014 |
| JP | 2005177706 | A | 7/2005 |
| WO | WO 2013097375 | A1 * | 7/2013 |

* cited by examiner

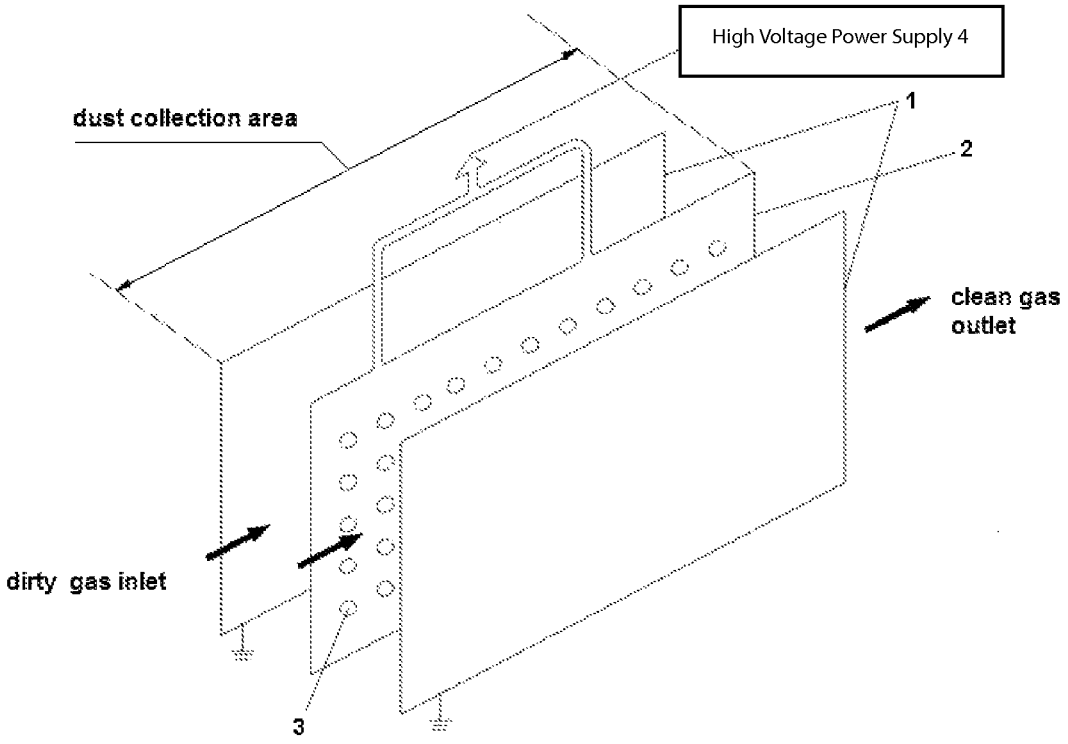
High Voltage Power Supply 4
dust collection area
1
2
clean gas outlet
dirty gas inlet
3

SINGLE-REGION-BOARD TYPE HIGH-TEMPERATURE ELECTROSTATIC DUST COLLECTOR

FIELD OF TECHNOLOGY

The present invention, a single-region-board type high temperature electrostatic dust collector, belongs to the field of environmental protection equipment and technology.

BACKGROUND

As a main content of the high-temperature purification technology, high temperature dust removal technology is not only the key of the development of the current IGCC power generation technology and PFBC power generation technology but also particularly important to the development of the more advanced coal-fired combined cycle power generation technology. In addition, it is also widely applied in chemistry industry where many high temperature gases used as either desiccation or heating media must be purified.

Researchers have studied the high-temperature purification technology since 1970s. Generally speaking, owing to the earlier researches, some developed countries, including the United States, Germany, Japan, the United Kingdom and the Netherlands, are in the leading position of this technology.

To date, the high-temperature dust removing technology mainly includes: electrostatic precipitation, cyclone, ceramic filter, metal felt filter and moving granular bed filter. An electrostatic precipitator (ESP) is characterized as low pressure drop loss, no clogging, large amount of flue gas purification and high collection efficiency especially in the part of the fine particle collection. Traditional ESPs are corona electrostatic dust collectors which are based on the high-voltage corona discharge. In the high-temperature ambience, corona phenomenon is difficult to maintain due to its corona running in a small voltage range and electrical insulation problems is hard to solve because of its high operating voltage (up to 50-100 KV). As a result, A traditional ESP is fit to be used in the low-temperature ambience of less than 450° C. This invention, a kind of no corona electrostatic precipitation, based on the thermal electron emission, has good prospects of development and extensive application prospects in the field of high-temperature flue gas clean up.

SUMMARY

A technical problem to be solved by the present invention is to provide a single-region-board type high temperature electrostatic dust collector which is compact in structure and space saving as well as improves working stability and reliability under high temperature.

In order to solve the above technical problem, the present invent comprises: anode boards, cathode boards, electron-emitting electrodes and a high voltage power supply. Two parallel corrosion resistant plates are grounded to form the anode boards. One corrosion resistant plate with the same shape and size as the anode boards connects to the cathode of the high voltage power supply, so as to form the cathode boards, which are suspended between the two anode boards and parallel with the anode boards. The disk-shaped emitting electrodes are uniformly embedded at two sides of the cathode board.

Among them, the electron-emitting electrode is made of a barium-tungsten thermal electron emission material doped cerium oxide, which comprises the mass percentage of 1~2% CeO2 and 98~99% tungsten powder. And the porous tungsten matrix doped cerium oxide is impregnated with aluminates.

Firstly the electron-emitting electrode is heated to emit a large number of free electrons. Then parts of them become negative ions after captured by some gases in the flue gases. Under the electric force, the free electrons and negative ions move towards the anode board. When the high temperature flue gas containing dust is flowing into the workspace, the dust captures the negative ions and free electrons and becomes charged particles. Then, under the action of electric force, the charged dusts move to the anode boards and thus collected.

The present invention is a single-region-board type high temperature electrostatic dust collector. Its advantages can be summarized as follows: (1) The electron-emitting electrode is directly heated by the thermal energy of high temperature flue gases to emit electrons, thus realizing the effective use of flue gas waste heat and saving energy; (2) The barium-tungsten hot electron emission material doped cerium oxide has the advantages of low surface work function, large emission current density, strong ability to resist material-poisoning. Therefore, using the emitting electrode made of the barium-tungsten hot electron emission material doped cerium oxide is conducive to improve the dust removal efficiency and extend equipment life; (3) To the single-region-board ESP, the dust-charged zone can be simultaneously utilized as and collection zone. This makes the device compact in structure, saving space as well as making fall use of the characteristics of high current density and low operating voltage. Besides, the board structure makes the electric field distribute uniformly, thereby improving the stability and reliability in the high temperature conditions.

BRIEF DESCRIPTION

FIG. 1 is the structure diagram of the single-region-board type high temperature electrostatic dust collector.

DETAILED DESCRIPTION

According to the FIG. 1 and some implementation examples, the present invention will be described further as followings:

Implementation Example 1

Shown in FIG. 1, the present invention comprises the anode boards 1, the cathode boards 2, the emitting electrodes 3 and the high voltage power supply 4. Two parallel corrosion resistant plates are grounded to form the anode boards 1. One corrosion resistant plate with the same shape and size as the anode boards connects to the cathode of the high voltage power supply, so as to form the cathode boards 2, which are suspended between the two anode boards 1 and parallel with the anode boards. The disk-shaped emitting electrodes 3 made of the barium-tungsten hot electron emission material doped cerium oxide are uniformly embedded at two sides of the cathode boards 2.

The barium-tungsten thermal electron emission material doped cerium oxide is a barium tungsten composite functional material with adding rare earth oxides CeO2, which comprises the mass percentage of 1% CeO2 and 99% tungsten powder. The porous tungsten matrix doped cerium oxide is impregnated with aluminates. The preparation method of the barium-tungsten thermal electron emission material doped cerium oxide is as follows. After the course of sintering annealing, the dry tungsten powder is mixed with the cerium oxide. Then the mixture becomes porous substrate after drying, compression molding and sintering. Finally, impregnate the porous substrate with aluminates in the atmosphere of hydrogen.

Under the conditions of 0.1 Mpa, 657° C. and 6000V, the measured dust removal efficiency of the single-region-board type high temperature electrostatic dust collector of this implementation example is 83.3%.

Implementation Example 2

It is basically the same as implementation example 1. The difference is: the barium tungsten composite functional material added rare earth oxides CeO2 comprises the mass percentage of 1.1% CeO2 and 98.9% tungsten powder. The porous tungsten matrix doped cerium oxide is impregnated with aluminates. Under the conditions of 0.1 Mpa. 690° C. and 6000V the measured dust removal efficiency of the single-region-board type high temperature electrostatic dust collector of this implementation example is 95.1%.

Implementation Example 3

It is basically the same as implementation example 1. The difference is: the barium tungsten composite functional material added rare earth oxides CeO2 comprises the mass percentage of 1.2% CeO2 and 98.8% tungsten powder. The porous tungsten matrix doped cerium oxide is impregnated with aluminates. Under the conditions of 0.1 Mpa, 566° C. and 6000V, the measured dust removal efficiency of the single-region-board type high temperature electrostatic dust collector of this implementation example is 78.2%.

Implementation Example 4

It is basically the same as implementation example 1, The difference is: the barium tungsten composite functional material added rare earth oxides CeO2 comprises the mass percentage of 1.5% CeO2 and 98.5% tungsten powder. The porous tungsten matrix doped cerium oxide is impregnated with aluminates. Under the conditions of 0.3 Mpa, 820° C. and 5000V, the measured dust removal efficiency of the single-region-board type high temperature electrostatic dust collector of this implementation example is 92.1%.

Implementation Example 5

It is basically the same as implementation example 1. The difference is: the barium tungsten composite functional material added rare earth oxides CeO2 comprises the mass percentage of 1.7% CeO2 and 98.3% tungsten powder. The porous tungsten matrix doped cerium oxide is impregnated with aluminates. Under the conditions of 0.4 Mpa, 823° C. and 6000V, the actual measured dust removal efficiency of the single-region-board type high temperature electrostatic dust collector of this implementation example is 93.9%.

Implementation Example 6

It is basically the same as implementation example 1. The difference is: the barium tungsten composite functional material added rare earth oxides CeO2 comprises the mass percentage of 1.8% CeO2 and 98.2% tungsten powder. The porous tungsten matrix doped cerium oxide is impregnated with aluminates. Under the conditions of 0.6 Mpa, 820° C. and 6000V, the actual measured dust removal efficiency of the single-region-board type high temperature electrostatic dust collector of this implementation example is 93.3%.

The thermal electron emitter is made of a barium tungsten composite functional material doped cerium oxide. It is heated by the high temperature flue gas own heat or other heating methods to emit electrons, which makes the dust charged. Then, under the electric force, the charged dusts are separated from the flue gas and captured. On the one hand, the present invention can use the flue gas waste heat effectively, thus saving energy. On the other hand, because the emission current density is high (more than two orders of magnitude higher than that of the corona electrostatic dust collector), the collection efficiency of dust particles, especially fine particles is greatly improved. In addition, the low operating voltage of this device makes the problem of high-temperature electrical insulation conducive to be resolved.

What is claimed is:

1. A single-region-board type high temperature electrostatic dust collector comprising:

a plurality of anode boards, a plurality of cathode boards, and a plurality of electron-emitting electrodes;

a high voltage power supply;

two parallel corrosion resistant plates being grounded to form the plurality of anode boards;

wherein one corrosion resistant plate with a same shape and a size as the plurality of anode boards connects to the high voltage power supply, so as to form the plurality of cathode boards, which are suspended between two anode boards and parallel with the plurality of anode boards;

wherein a plurality of disk-shaped emitting electrodes are uniformly embedded at two sides of the plurality of cathode boards;

wherein the plurality of electron emitting electrodes are made of a barium-tungsten thermal electron emission material doped cerium oxide, which comprises a mass percentage of 1~2% CeO2 and 98~99% tungsten powder, further wherein a porous tungsten matrix doped cerium oxide is impregnated with aluminates.

* * * * *